United States Patent [19]

Lindemann

[11] Patent Number: 4,535,792

[45] Date of Patent: Aug. 20, 1985

[54] APPARATUS FOR TREATING PERFORATED WEBS OF TIPPING PAPER OR THE LIKE

[75] Inventor: Rolf Lindemann, Oststeinbek, Fed. Rep. of Germany

[73] Assignee: Hauni-Werke Körber & Co. KG., Hamburg, Fed. Rep. of Germany

[21] Appl. No.: 419,394

[22] Filed: Sep. 17, 1982

[30] Foreign Application Priority Data

Feb. 17, 1982 [DE] Fed. Rep. of Germany ..... 3205661

[51] Int. Cl.[3] ..... A24F 5/60

[52] U.S. Cl. ..... 131/281

[58] Field of Search ..... 219/384; 131/281

[56] References Cited

U.S. PATENT DOCUMENTS 4,281,670 8/1981 Heitmann et al. ..... 131/281

4,390,032 6/1983 Labbe et al. ..... 131/281

FOREIGN PATENT DOCUMENTS 2057246 4/1981 United Kingdom ..... 131/281

*Primary Examiner*—V. Millin

*Attorney, Agent, or Firm*—Peter K. Kontler

[57] ABSTRACT

A running web of cigarette paper or tipping paper, which is formed with one or more groups of longitudinally extending perforations by heating and resulting burning or charring selected portions of the web, is treated by one or more wiping devices which sweep along one or both sides of the web, at least in the region of the group or groups of perforations. The wiping device or devices can employ one or more rotary brushes in conjunction with one or more back supports in the form of driven rollers or idler rollers, or a stationary pad which is biased against the web to thereby urge the web against a stationary back support. The wiping device or devices enhance the appearance of the web by reducing the visual contrast between the perforated and non-perforated portions.

9 Claims, 3 Drawing Figures

APPARATUS FOR TREATING PERFORATED WEBS OF TIPPING PAPER OR THE LIKE

BACKGROUND OF THE INVENTION

The present invention relates to apparatus for treating perforated webs of cigarette paper, imitation cork, tipping paper or like material. More particularly, the invention relates to apparatus which can be used with advantage for the treatment of webs whose perforations are formed by burning holes in the material of the web. Still more particularly, the invention relates to apparatus for treating running webs of perforated cigarette paper, tipping paper or like material subsequent to the making of perforations by resorting to heat generating means.

Many manufacturers of cigarettes and analogous smokers' products believe that the admission of cool atmospheric air into the column of hot tobacco smoke which passes through a lighted cigarette will reduce the presumably deleterious effects of smoke upon the health of the smoker. Therefore, numerous brands of cigarettes exhibit wrappers which are formed with perforations, e.g., in the region where the filter mouthpiece of a filter cigarette is connected with the tobacco-containing portion. The perforations can be made in cigarette paper, in the paper which is used to form the wrapper of a filter rod, or in the so-called tipping paper which is used to connect filter mouthpieces with cigarettes of unit length or multiple unit length, e.g., in so-called filter tipping machines. Examples of such machines are those known as MAX and MAX-S, both manufactured by the assignee of the present application. Commonly owned U.S. Pat. No. 4,277,678, granted Jul. 7, 1981 to Wahle et al., discloses a MAX-S filter tipping machine. The disclosure of this patent is incorporated herein by reference. Tipping paper is normally a web of cigarette paper, imitation cork or a like material one side of which is coated (at least in part) with a suitable adhesive before the leader of the web is subdivided into a succession of discrete uniting bands which are draped around filter mouthpieces and around the adjoining end portions of plain cigarettes to form filter cigarettes of unit length or multiple unit length.

Devices which are used to form perforations in tipping paper, cigarette paper or a like material include apparatus utilizing sets of needles or like mechanical piercing implements, apparatus which resort to one or more laser beams, and apparatus which utilize one or more pairs of electrodes whose electrodes are disposed at the opposite sides of the path for a running web and which are connected with sources of high-voltage impulses, e.g., in a manner as disclosed in commonly owned U.S. Pat. No. 4,247,754, granted Jan. 27, 1981 to Baier, whose disclosure is incorporated herein by reference. It has been found that, particularly when the perforations in a running web of tipping paper or the like are made by resort to heat, the appearance of the perforated portion of the web is often quite unsatisfactory so that the web can detract from the appearance of the ultimate product, especially since the perforated portion of the web is normally visible in the wrapper of a filter cigarette or a like smokers' product. The appearance of webs whose perforations are made by resort to pairs of heat-generating electrodes, i.e., as a result of burning or charring of the material of the web, is adversely affected for several reasons, for example, because some fragments of charred web material adhere to uncharred parts of the web, because the dimensions of the holes are not sufficiently uniform due to the presence of burned or partially combusted material in certain perforations, and/or others. On the other hand, the making of holes or perforations by resort to apparatus which combust selected portions of the running web is a very effective technique which is desirable for several reasons, e.g., because the apparatus takes up little room, because the perforations can be made at the rate at which the web must be transported in a high-speed filter tipping or like machine, because the combined cross-sectional area of perforations can be regulated with a high degree of accuracy and/or because the apparatus is not very complex and is not prone to malfunction.

OBJECTS AND SUMMARY OF THE INVENTION

An object of the invention is to provide a novel and improved apparatus for treating perforated webs of cigarette paper, tipping paper or like flexible material.

Another object of the invention is to provide an apparatus which can enhance the appearance of perforated webs of cigarette paper or the like.

A further object of the invention is to provide an apparatus which is especially suited for the treatment of webs whose perforations are formed by resorting to heat, i.e., by combusting selected portions of the running web.

An additional object of the invention is to provide an apparatus which is sufficiently compact to find room in existing filter tipping and like machines wherein webs of cigarette paper, tipping paper or like material are perforated by resorting to heat generating means.

Still another object of the invention is to provide an apparatus which can treat perforated webs at the rate at which such webs are transported in modern high-speed tobacco processing machines.

A further object of the invention is to provide an apparatus which requires a minimum of attention, which can stand long periods of use, and which can treat wide, narrow, highly flexible, relatively stiff, readily breakable or high-tensile-strength webs with equal or nearly equal facility.

Another object of the invention is to provide a method of enhancing the appearance of a running web whose perforations are formed by resorting to heat.

One feature of the invention resides in the provision of an apparatus for treating a running perforated web which is advanced along a predetermined path, particularly for treating a running web wherein the perforations are formed by the application of heat and resultant burning or charring of portions of the material of the web. The apparatus comprises a wiping device which is adjacent to at least one side of the aforementioned path and contacts the respective side of the running web. The apparatus can further comprise means for moving the wiping device with reference to the running web. For example, if the wiping device includes at least one rotary brush whose bristles contact one side of the running web, the moving means can comprise a shaft which rotates the brush about a fixed axis so that the bristles sweep along the one side of the running web.

It is equally possible to employ a stationary wiping device, e.g., a block one side of which is coated with a suitable web-contacting material along which the respective side of the running web slides.

If the perforations are formed in one or more selected portions of the web, e.g., in regions which extend lengthwise of the web, the wiping device is preferably positioned to contact only such selected portions of the running web. For example, if the web is formed with one or more groups or tracks of longitudinally extending rows of perforations, the wiping device can comprise a discrete brush for each of the groups and means for rotating the brush or brushes so that the bristles sweep along the respective group or groups of perforations.

Each embodiment of the improved apparatus can comprise a suitable back support for the web. Such back support is then disposed at the other side of the path for the web opposite the wiping device. For example, if the wiping device comprises a brush or an analogous rotary element at one side of the path, the back support can comprise an idler roller or an analogous rotary element at the other side of the path. The circular peripheral surface of the roller then contacts the other side of the web while the one side of the web is swept by the bristles of the brush.

Irrespective of whether the wiping device is mobile or stationary, the apparatus can further comprise means (e.g., one or more coil springs) for biasing the wiping device against the one side of the web and/or for biasing the back support against the other side of the web. For example, if the wiping device comprises a stationary wiping pad which is disposed opposite a stationary back support, the spring or springs can be installed to bias the pad against the running web which is thereby biased against the back support.

In accordance with a presently preferred embodiment, the wiping device comprises at least one rotary brush and the back support is an idler roller or a driven roller disposed at the other side of the path for the web opposite the brush. The brush and the roller then define a nip for the passage of the web, and the brush can be rotated clockwise or counterclockwise, preferably at a speed such that its bristles move relative to the running web.

The wiping device is preferably installed in a tobacco processing machine immediately or closely downstream of the means (such as that disclosed in the patent to Baier) which makes perforations in the running web.

Another feature of the invention resides in the provision of a method of enhancing the appearance of a running perforated web which consists of cigarette paper or the like, particularly a web whose perforations are formed by the application of heat and resultant combustion or charring of portions of the web. The method comprises the steps of advancing the web along a predetermined path, and wiping at least one side of the running web in a predetermined portion of the path.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
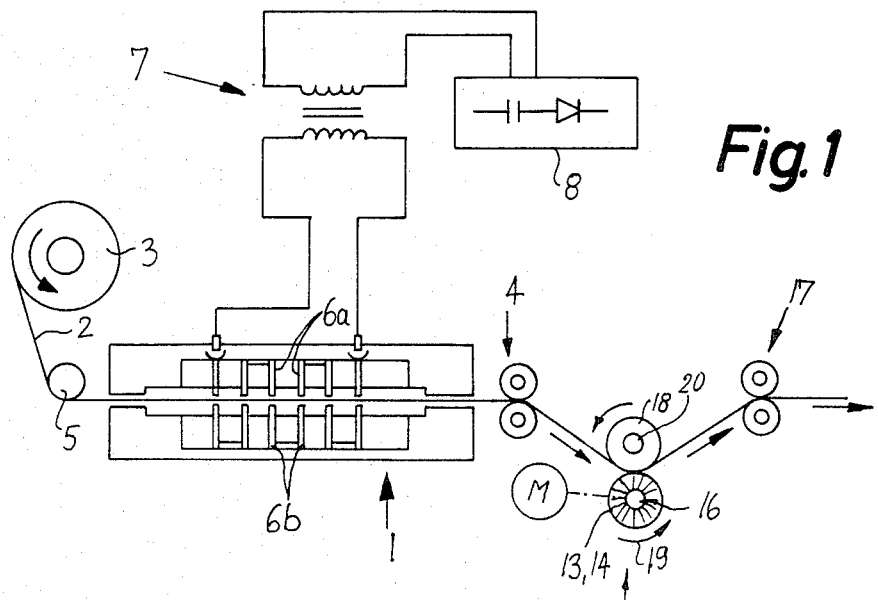
FIG. 1 is a schematic elevational view of a web perforating unit and of an apparatus which treats the perforated web in accordance with one feature of the present invention.
Figure 2:
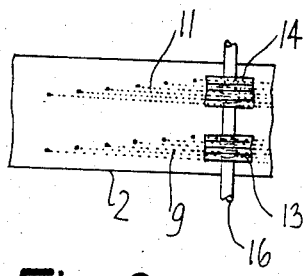
FIG. 2 is a fragmentary bottom plan view as seen in the direction of arrow II in FIG. 1.

Referring first to FIGS. 1 and 2, there is shown a portion of a filter tipping machine, e.g., a machine of the type disclosed in the aforementioned patent to Wahle et al. The machine comprises a perforating unit 1 for a running web 2 of tipping paper which is drawn off a reel 3 by a pair of advancing rolls 4 and is guided by an idler roller 5 so that its path between the roller 5 and the nip of the advancing rolls 4 is straight. The perforating unit 1 includes a first set of electrodes *6a* at the upper side of the path of the web 2 between the roller 5 and advancing rolls 4, a second set of electrodes *6b* below such path, and a device which applies to the electrodes high-voltage impulses, for example, in a manner as disclosed in the aforementioned patent to Baier. This results in the formation of two groups or tracks 9 and 11 of perforations which extend lengthwise of the running web 2 (note FIG. 2). The reference character 8 denotes in FIG. 1 an impulse generating device which cooperates with a transformer 7 to apply high-voltage impulses to the electrodes which flank the path of the web 2. The provision of two tracks or groups of perforations (each such track or group can consist of several rows of perforations) is due to the positioning of electrodes *6a, 6b* relative to the path of the web 2. Reference may be had to FIG. 2 of the patent to Baier. It has been found that, in the absence of any treatment, the tracks or groups 9 and 11 are readily discernible or distinguishable from the remaining portions of the running web 2.

In order to reduce the contrast between the perforated and non-perforated portions of the web 2, there is provided a web treating apparatus which comprises a wiping device including two coaxial rotary elements 13, 14 in the form of brushes whose bristles contact and sweep along the underside of the running web 2. The means for rotating the brushes 13, 14 about a common horizontal axis in the direction of arrow 19 comprises a drive shaft 16 which can receive torque from the main prime mover of the tipping machine or from a separate prime mover, such as a reversible variable-speed electric motor M.

The brushes 13, 14 are disposed opposite a back support 18 which contacts and flexes the upper side of the web 2 between the nip of the advancing rolls 4 and the nip of a second pair of advancing rolls 17. The back support 18 can constitute an idler roller whose circular peripheral surface engages the upper side of the running web 2. The wiping device including the brushes 13, 14 defines with the back support 18 a nip for the web 2, and the bristles of the brushes 13, 14 treat successive increments of the web with the aforediscussed beneficial results. If desired, the roller or back support 18 can be driven by its shaft 20 to rotate in the direction indicated by the arrow. In FIG. 1, the motor M is assumed to drive the shaft 16 (and preferably also the shaft 20) in a counterclockwise direction. However, it is equally possible to drive the shaft 16 in a clockwise direction, as long as the bristles of the brushes 13, 14 move relative to the respective side of the web 2. The arrangement is preferably such that the peripheral speed of the brushes 13, 14 exceeds the speed of lengthwise movement of the web 2. The speeds of the brushes 13, 14 and back support 18 are preferably synchronized with that of the web 2 (i.e., with the speeds of the advancing rolls 4 and 17) in such a way that the rotational speed of the brushes 13, 14 and back support 18 is proportional to the (normally varying) speed of the web 2. In other words, and especially if all of these parts receive motion from the main prime mover of the machine wherein the improved apparatus is installed, the peripheral speed of the parts 13, 14, 18 increases or decreases proportionally with increasing or decreasing speed of lengthwise movement of the web 2. The connection between the motor M and the shaft 16 preferably includes a clutch or a switch which is designed to arrest the motor M or to disconnect the motor from the shaft 20 and/or 16 as soon as the speed of the web 2 is reduced to zero or to a certain minimum permissible speed.

Figure 3:
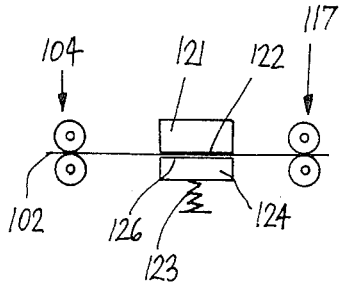
FIG. 3 is a schematic elevational view of a modified web treating apparatus.

FIG. 3 illustrates a modified apparatus wherein the wiping device 121 is stationary and is provided with a suitable pad 122 contacting the upper side of the running web 102. The web 102 is advanced by the pairs of rolls 104 and 117 which flank the improved apparatus. The back support includes a stationary block 124 having a pad 126 which contacts the underside of the running web 102 opposite the pad 122. One or more coil springs 123 or other suitable means are provided to bias the back support 124 toward the wiping device 121. If desired, the back support 124 can constitute the wiping device, or the wiping device can include two components (121, 124) at the opposite sides of the path for the running web 102. In this embodiment of the invention, the pads 122, 126 simultaneously treat both sides of the web.

The apparatus of FIG. 2 or 3 can be modified by using a mobile (rotary) wiping device and a stationary pad or vice versa. For example, the brushes 13, 14 of the wiping device shown in FIGS. 1 and 2 can be used in conjunction with the parts 121, 122 or 124, 126 of FIG. 3, or the rotary element 18 of FIG. 2 can be used in combination with the device 121, 122 or 124, 126 of FIG. 3 without departing from the spirit of the invention.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. Apparatus for treating a running perforated web which is advanced along a predetermined path and whose perforations are formed by the application of heat to and resulting burning or charring of portions of the material of the web, comprising a mechanical wiping device adjacent to at least one side of said path and bodily contacting the respective side of the running web; and a back support disposed at the other side of said path opposite said wiping device.

2. The apparatus of claim 1, further comprising means for moving said wiping device with reference to the running web.

3. The apparatus of claim 1, wherein said back support comprises a rotary element having a circular peripheral surface contacting the respective side of the running web.

4. The apparatus of claim 1, wherein said wiping device is installed in a tobacco processing machine downstream of the unit which makes perforations in the running web.

5. Apparatus for treating a running perforated web which is advanced along a predetermined path, particularly a web whose perforations are formed by the application of heat to and resultant burning or charring of portions of the material of the web, comprising a wipping device adjacent to at least one side of said path and contacting the respective side of the running web, said wiping device including a rotary brush having web-contacting bristles; and means for moving said wiping device with reference to the running web, including means for rotating said brush so that the bristles sweep along the respective side of the running web.

6. Apparatus for treating a running perforated web which is advanced along a predetermined path, particularly a web whose perforations are formed by the application of heat to and resultant burning or charring of portions of the material of the web, comprising a stationary wiping device adjacent to at least one side of said path and contacting the respective side of the running web.

7. An apparatus for treating a running perforated web which is advanced along a predetermined path and wherein the perforations are disposed in at least one selected web portion extending lengthwise of the web, particularly for treating a web whose perforations are formed by the application of heat to and resultant burning or charring of portions of the material of the web, comprising a wiping device adjacent to at least one side of said path and contacting the respective side of the running web, said wiping device being positioned to contact only said selected portion of the running web.

8. An apparatus for treating a running web which is advanced along a predetermined path, particularly a web whose perforations are formed by the application of heat to and resulting burning or charring of portions of the material of the web, comprising a wiping device adjacent to at least one side of said path and contacting the respective side of the running web; a stationary back support disposed at the other side of said path opposite said wiping device, said back support including a rotary element having a circular peripheral surface contacting the respective side of the running web; and means for biasing said wiping device against the running web so that the web is urged against said back support.

9. An apparatus for treating a running perforated web which is advanced along a predetermined path and whose perforations are formed by the application of heat to and resulting burning or charring of portions of the material of the web, comprising a mechanical wiping device adjacent to at least one side of said path and bodily contacting the respective side of the running web, said wiping device including a first rotary element; and a second rotary element disposed at the other side of said path opposite said first rotary element, said elements defining a nip for the passage of the web therethrough.

* * * * *